US005746660A

United States Patent [19]

Grover

[11] Patent Number: 5,746,660

[45] Date of Patent: May 5, 1998

[54] GAME TABLE TILT AND ROLL SUPPORT

[75] Inventor: Douglas B. Grover, Phoenix, Ariz.

[73] Assignee: T & R Assembly, Inc., Alma, Mich.

[21] Appl. No.: 564,469

[22] Filed: Nov. 29, 1995

[51] Int. Cl.[6] ..... A63B 71/00

[52] U.S. Cl. ..... 473/15; 108/6; 108/177; 108/179

[58] Field of Search ..... 473/4–10, 15; 108/6, 10, 116, 127, 129, 131, 132, 149, 177, 179, 176

[56] References Cited

U.S. PATENT DOCUMENTS

| | | | |
|---|---|---|---|
| 653,727 | 7/1900 | Zentner | 473/9 |
| 747,097 | 12/1903 | Spalt . | |
| 1,063,642 | 6/1913 | Birdsall | 108/132 |
| 3,661,100 | 5/1972 | Tennant | 108/132 |
| 4,305,581 | 12/1981 | Neuthart | 473/15 |
| 5,055,780 | 10/1991 | Tsang | 473/15 |
| 5,109,778 | 5/1992 | Berkowitz | 108/127 |

FOREIGN PATENT DOCUMENTS

| | | | |
|---|---|---|---|
| 238471 | 9/1987 | European Pat. Off. | 473/15 |

*Primary Examiner*—Theatrice Brown
*Attorney, Agent, or Firm*—Gregory J. Nelson

[57] ABSTRACT

A tilt and roll support for pool tables and other game tables having a frame attached to the underside of the table. The opposite ends of the frame have pivot shafts which are axially aligned with the longitudinal axis of the table. Support assemblies at the ends of the table are pivotally about the pivot shafts so the table may be rotated between a vertical stored position and a horizontal use position. The lower portion of the support assemblies are retractable against the bottom of the table for storage and may be extended to a vertical position. The lower portion of the support assemblies are on rollers or casters and are extendible so the weight of the table may be transferred to the tilt and roll supports for movement and storage. When the table is in use, the table is supported on conventional legs.

8 Claims, 4 Drawing Sheets

GAME TABLE TILT AND ROLL SUPPORT

FIELD OF THE INVENTION

The present invention relates to a game table support and more particularly relates to a temporary support structure termed a "tilt and roll assembly" which will permit heavy tables, such as pool tables, to be pivoted from the normal horizontal playing or use-position to a vertical position in which the weight of the table is removed from the normal supporting legs enabling the table to be conveniently moved to a stored in an out-of-the-way position.

Many recreational games are played upon a surface which is formed as the top of a table surface. Representative of these games are pool, billiards, ping pong, card games and other games. Many of these game tables are large, bulky and are of substantial weight and accordingly, these tables often occupy a substantial portion of the room area when in their normal use-position. Therefore, when the table is not being used, game tables often occupy space which could otherwise be used. Because of the bulk and weight of tables of this type, it is often not feasible to manually lift these types of tables and move them from one location to another Even if the table is moved, it nevertheless occupies a substantial area. For example, a conventional standard size pool table measures approximately 98 inches by 96 inches and may weigh in excess of 500 lbs.

Various table supporting devices which permit a table be folded to a stored position can be found in the prior art. For example, the prior art includes supports for ping pong tables in which the table is hinged along a transverse center line so that the table may be folded in half for storage. This arrangement is suitable for lighter weight playing tables but is not suitable for heavy game tables such as billiard or pool tables. Further, such arrangements result in a joint or fold line extending across and interfering with the top surface of the table. Such an arrangement would not be acceptable in the case of games of precision such as pool or billiards.

U.S. Pat. No. 3,585,945 discloses a pool table which is provided with a pair of leg structures pivotal between an erect and a collapsed position. A mobile support structure is provided which includes a pair of wheel-supporting members connected to the frame of the pool table for movement between operative and inoperative positions. The wheel mounting members, when in the operative position, foldably support the table after the table has been turned upon one longitudinal edge permitting movement of the table. The pool table support described in this patent provides certain advantages.

My prior patent, U.S. Pat. No. 3,988,021 discloses an improved game table having a support structure including leg assemblies located at the ends of the table. The leg assemblies each have a first member pivotally attached to the table along the longitudinal axis of the table and a second member pivotally attached to the first and to a caster pedestal. The pedestals are interconnected by an adjustable rod which can be extended or retracted to level, raise or lower the table. Adjustable braces extend between the table top and the pedestals. The table top can be pivoted to a generally vertical position thereby accommodating movement and storage while not in use.

BRIEF SUMMARY OF THE INVENTION

Briefly in summary, the present invention provides a support structure for game or other heavy tables which support structure may be termed a "tilt and roll" assembly. The table support structure has a support frame which is attached to the underside of the table. The opposite ends of the frame each carry pivot shafts which are axially aligned with the longitudinal axis of the table and positioned along the center of gravity of the table top. A pair of identical tilt and roll leg assemblies are positioned at opposite ends of the table and each include an upper fixed support which is pivotally attached to the table support frame so the table top may be pivoted between a generally horizontal and vertical position. A lower tubular leg member is pivotal with respect to the upper leg member along a transverse axis. The upper and lower leg members may be locked in vertical alignment by a locking member such as a pin. When the locking pin is released, the lower leg members may be folded inwardly to a stored position generally parallel to the table surface and secured in this position by relocating the locking pin. In the retracted position, the tilt and roll assemblies are concealed beneath the table by the table edge or rail.

The tubular lower leg members of the tilt and roll assemblies each house a moveable piston which has a threaded shaft secured to one end of the piston which shaft extends and projects below the end of the lower pivot tube. A nut is in threaded engagement with the threaded shaft and abuts the lower end of the lower leg member. The lower end of the threaded screw or shaft carries a pedestal base which includes a pedestal bar having casters or rollers disposed at opposite ends. Rotating the nut will cause the piston to move relative to the lower leg member to retract or extend the tilt and roll leg assemblies.

The leg assemblies may be interconnected by a pair of detachable parallel rods to stabilize the opposed pedestal bases with respect to one another when they are disposed and locked in the downward position. When in use, the table is normally supported on four conventional legs which are pivotally mounted to the underside of the table. If it is desired to store the table in an out-of-the-way position, the lower legs of the tilt and roll assemblies are unlocked from their stored position and extended to a vertical position and locked in this position by a locking pin. The adjusting nuts are then rotated to cause the pedestal base members to extend until the weight of the table is removed from the conventional legs and is transferred to the tilt and roll assemblies. The conventional legs can then be pivoted to their stored position along the underside of the table. Once the conventional legs are stored, the table can then be pivoted to a generally vertical position for movement and storage. Tilting is easily accomplished as the table top is balanced with respect to the axis of rotation. The table side rails may be provided with cut-outs or recesses to accommodate fully pivoting the table to a vertical position. When the tilt and roll assemblies are stored, they are obscured from normal sight by the table side rails.

BRIEF DESCRIPTION OF THE DRAWINGS

The above and other objects and advantages of the present invention will become more apparent from the following specification, claim and drawings in which:

DETAILED DESCRIPTION OF THE INVENTION

Figure 7:
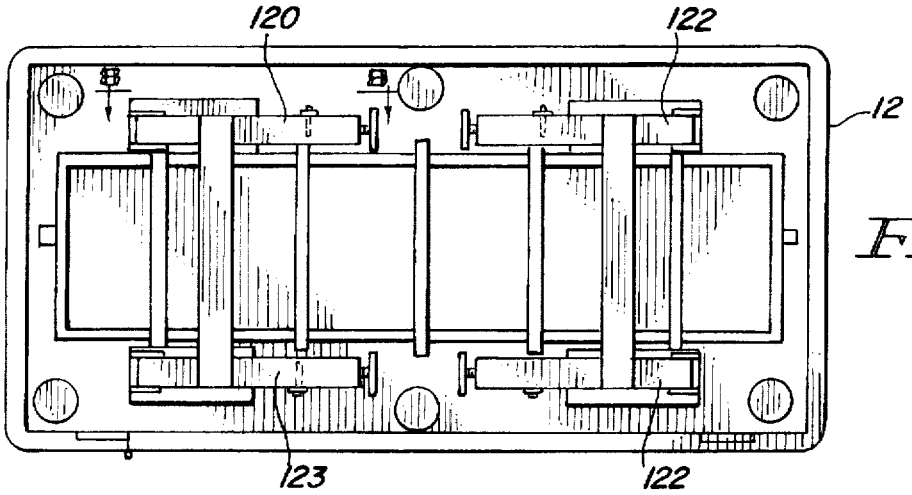
FIG. 7 is the bottom view of a game table showing the mounting frame and conventional legs in a folded position.
Figure 8:
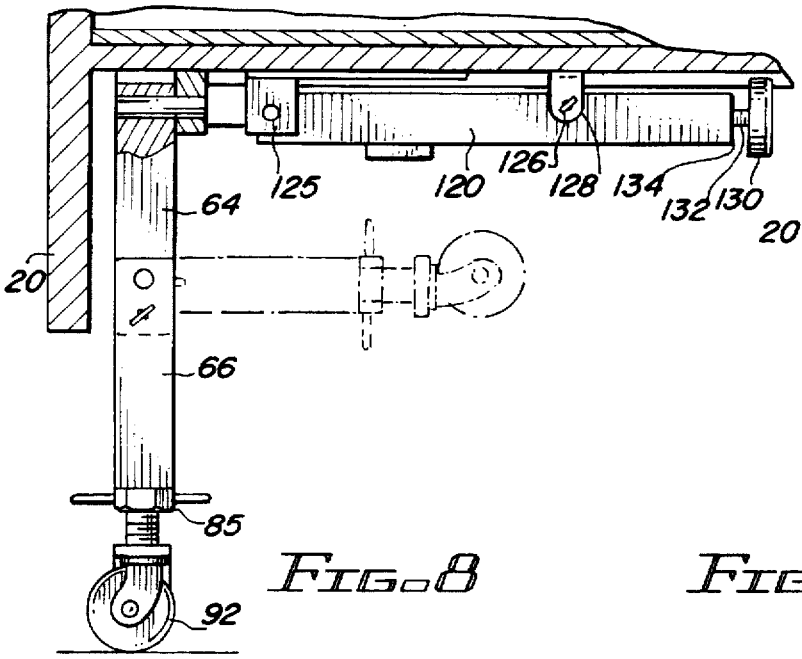
FIG. 8 is a sectional view taken along line 8—8 of FIG. 7 showing the temporary support legs extended.

Referring to the drawings, the game table tilt and roll support of the present invention is generally designated by the numeral 10 and is shown in conjunction with a game table 12. The game table 12 is, for purposes of illustration, shown as a pool or billiard table. However, table 12 may be a table of other types such as a ping pong table. The table 12 has a generally planar base 14 which is shown as being generally rectangular. In the case of a pool or billiard table, the base 14 is normally a heavy material such as slate. Side rails 16 and 18 and end rails-20 and 22 extend around the base 14 and depend downwardly a sufficient distance as seen in FIG. 8 to conceal the components beneath the table from normal sight. The table has an upper surface, not shown, which provides an appropriate playing surface. In the case of a pool table, the surface would normally consist of a felt covering over the slate base and the table would be provided with conventionally positioned pockets such as pockets 21 seen in FIGS. 7 and 9.

Figure 1:
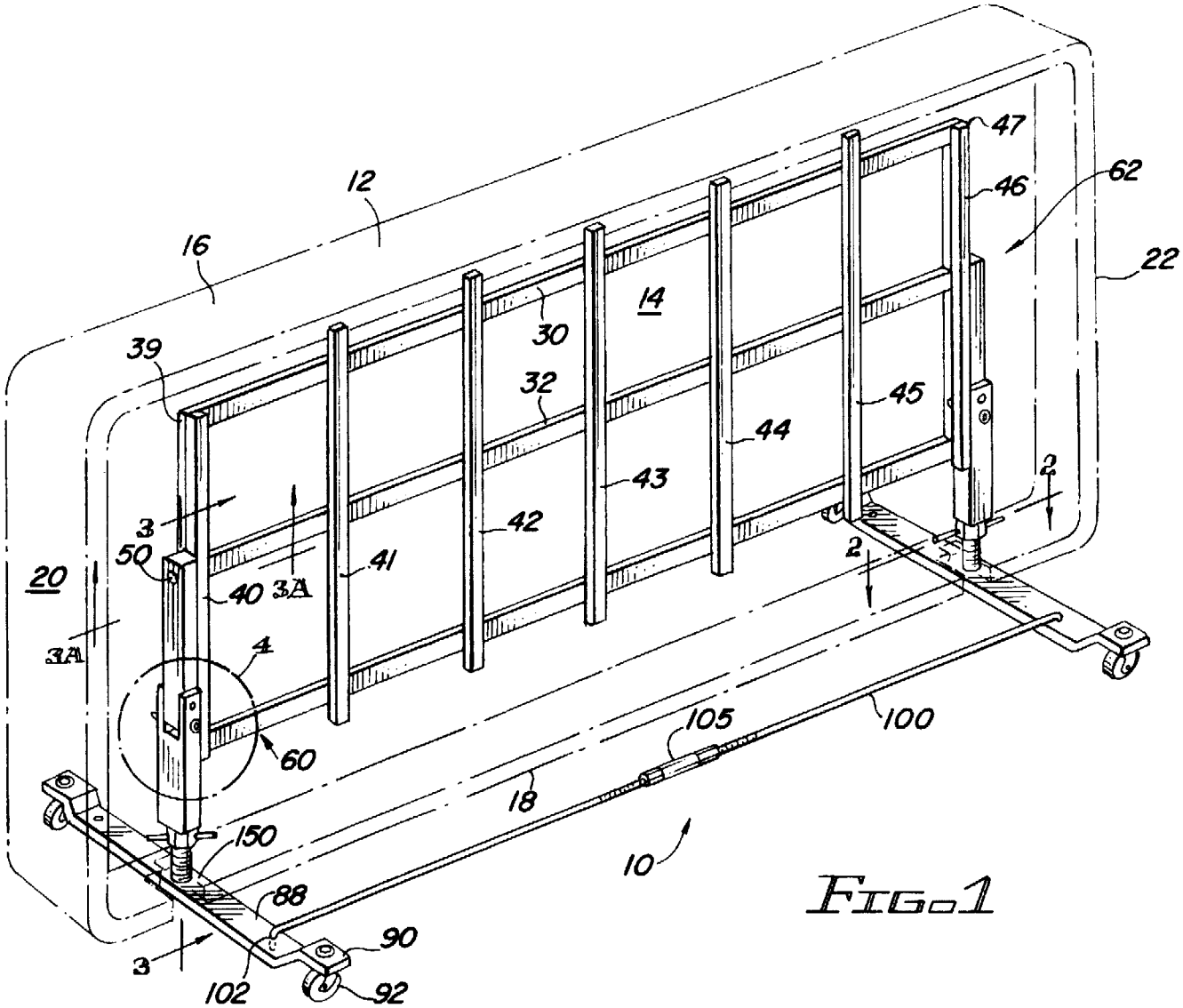
FIG. 1 is a perspective view showing the game table in phantom lines having tilt and roll support assemblies according to the present invention, the table being shown in a vertical, stored position.
Figure 2:
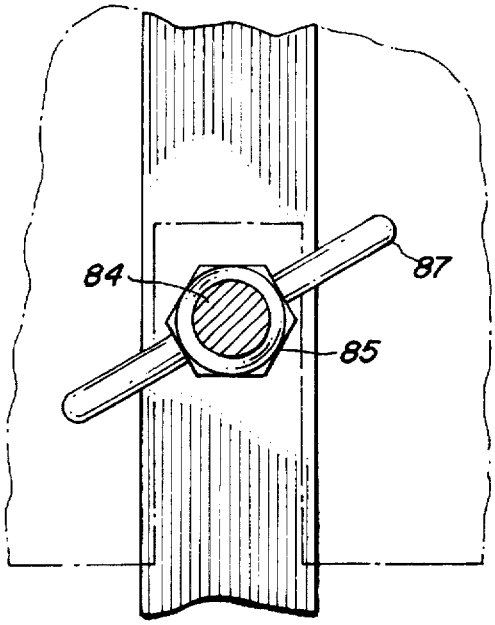
FIG. 2 is sectional view taken along line 2—2 of FIG. 1.
Figure 3:
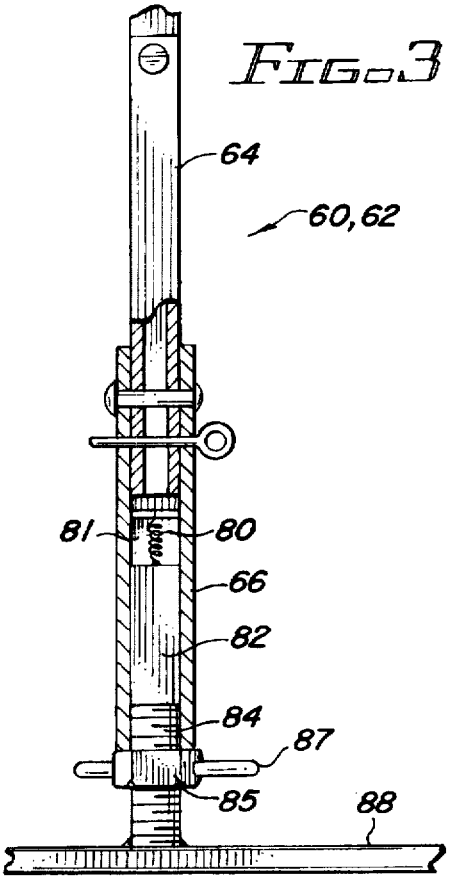
FIG. 3 is a sectional view taken along line 3—3 of FIG. 1.
Figure 3A:
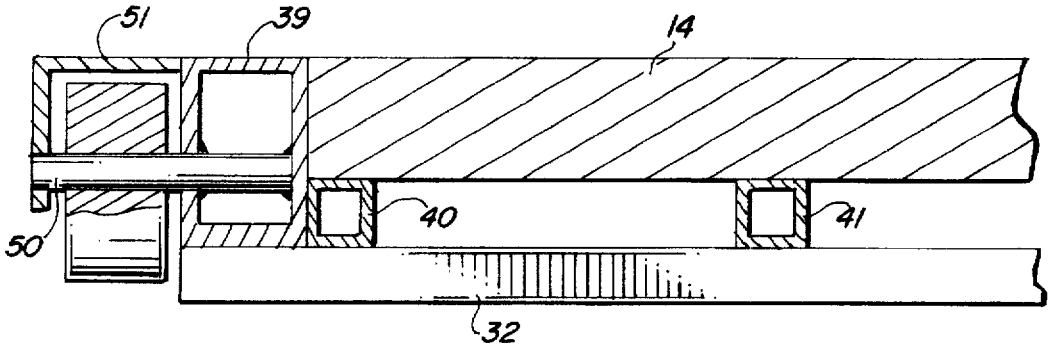
FIG. 3A is a sectional view taken along line 3A—3A of Figure.

The tilt and roll table assembly of the present invention includes a support frame 30 which is attached to the underside of the table base 14. The support frame 30 includes a centrally extending, longitudinal rail 32 with parallel rails 34 and 36 secured to the underside of the table by any convenient means. A plurality of transverse brace members 39, 40, 41, 42, 43, 44, 45, 46 and 47 complete the frame structure. These brace members extend across or attach to the longitudinally extending rail members. As seen in FIG. 3A, the slate base 14 is supported by this frame. An L-shaped retainer clip 51 is secured to braces 39 and 46, as seen in FIGS. 1 and 3A. When the table is tilted to the vertical position, the clips 51 assist to maintain the table in the vertical position.

Pivot stub shaft 50 extends from member 39 aligned with the axial center line and the center of gravity of the table type. Similarly, pivot shaft 54 projects from frame member 47 axially aligned with pivot shaft 50. The table is supported for pivotal movement between horizontal and vertical positions at pivot shafts 50 and 54 by a pair of opposed tilt and roll support assemblies 60 and 62 which are identical with respect to one another. Accordingly, a description of support assembly 60 will be sufficient, it being understood that this description also applies to support assembly 62.

Figure 4:
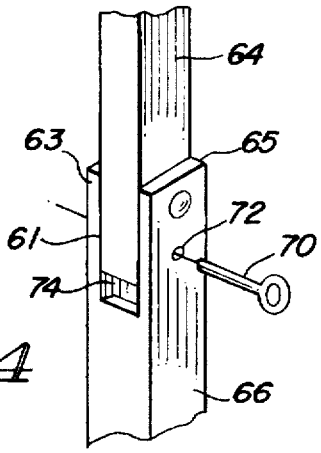
FIG. 4 is an enlarged detailed view of the pivot connection between the upper and lower leg members as indicated by the circle in FIG. 1.
Figure 5:
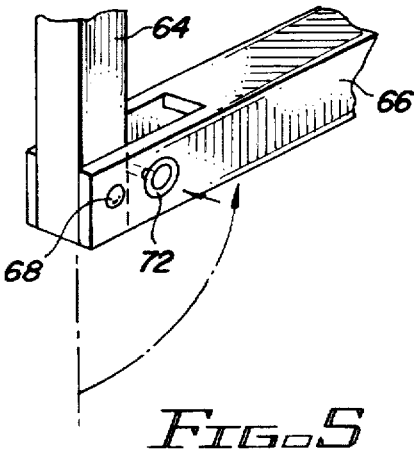
FIG. 5 is a view similar to FIG. 4 showing the lower legs members in a folded position.
Figure 6:
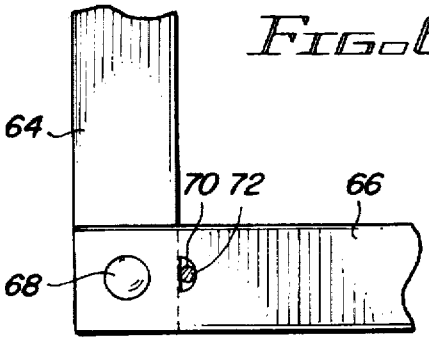
FIG. 6 is a side elevational view of the lower leg members in a folded position with the locking pin in place.

Support assembly 60 has an upper leg member 64 which is shown as being tubular in cross section. The upper end of leg member 64 defines a bore which receives pivot shaft 50. The lower end of leg member 64 is pivotally attached to lower leg member 66. Member 66 is shown in FIGS. 3 to 5 as being generally tubular having a recess 61 at its upper end which receives the lower end of leg member 64. A transverse pivot pin 68 pivotally secures the flanges 63, 65 which define recess 61, to the lower end of member 64 so that lower leg member 66 may be pivoted upwardly with respect to upper leg member 64. Leg members 64 and 66 may be secured in the extended, vertical position by pivot pin 70 which is engageable in bore 72 and member 66 and transverse bore 74 in lower end of member 64. When bores 72 and 74 are in registry, pin 70 may be inserted, locking the leg members in the extended position seen in FIG. 4. When pin 70 is removed, the lower leg member 66 may be pivoted upwardly as shown in FIG. 5 to a position assuming a general right angle with respect to member 64. Pin 70 may be then inserted in bore 72 as shown in FIG. 6. In this position, pin 70 abuts the inner edge of upper support member 64 preventing lower member 66 from pivoting downwardly.

Referring to FIGS. 3, 4 and 8 the lower leg member 66 is shown as being generally tubular in cross section and defines a hollow tubular interior 80 which slidably receives piston 82. The piston is returned in the tubular interior 80 by a spring 81 secured to the tube. The lower end of the piston 82 carries a threaded stub shaft 84 which extends below the bottom end of leg member 66. A threaded nut 85 abuts the lower end of member 66 and may be rotated relative to threaded shaft 84. One or more projecting wings or arms 87 are provided to assist in rotating the nut 85.

The lower distal end of the threaded shaft 84 is secured, as by welding, to a base which includes a pedestal 88. The opposite ends of the pedestal 88 are upwardly displaced at 90 at which location are secured casters 92. The casters may be any conventional type of rolling support and are preferably of the type that can be locked. The tilt and roll support assemblies 60, 62 may be secured and made rigid by stabilizer bars 100 which are engageable in apertures 102 in the pedestals 88. The stabilizer bars 100 have depending ends 104 which are insertable in the apertures. The length of the stabilizer bars 100 can be adjusted at intermediate turnbuckle 105. With stabilizing bar 100 positioned as shown in FIG. 1 and with an additional stabilizing bar positioned in the opposite side of the pedestal, the unit will be made more stable for transportation and storage.

Figure 11:
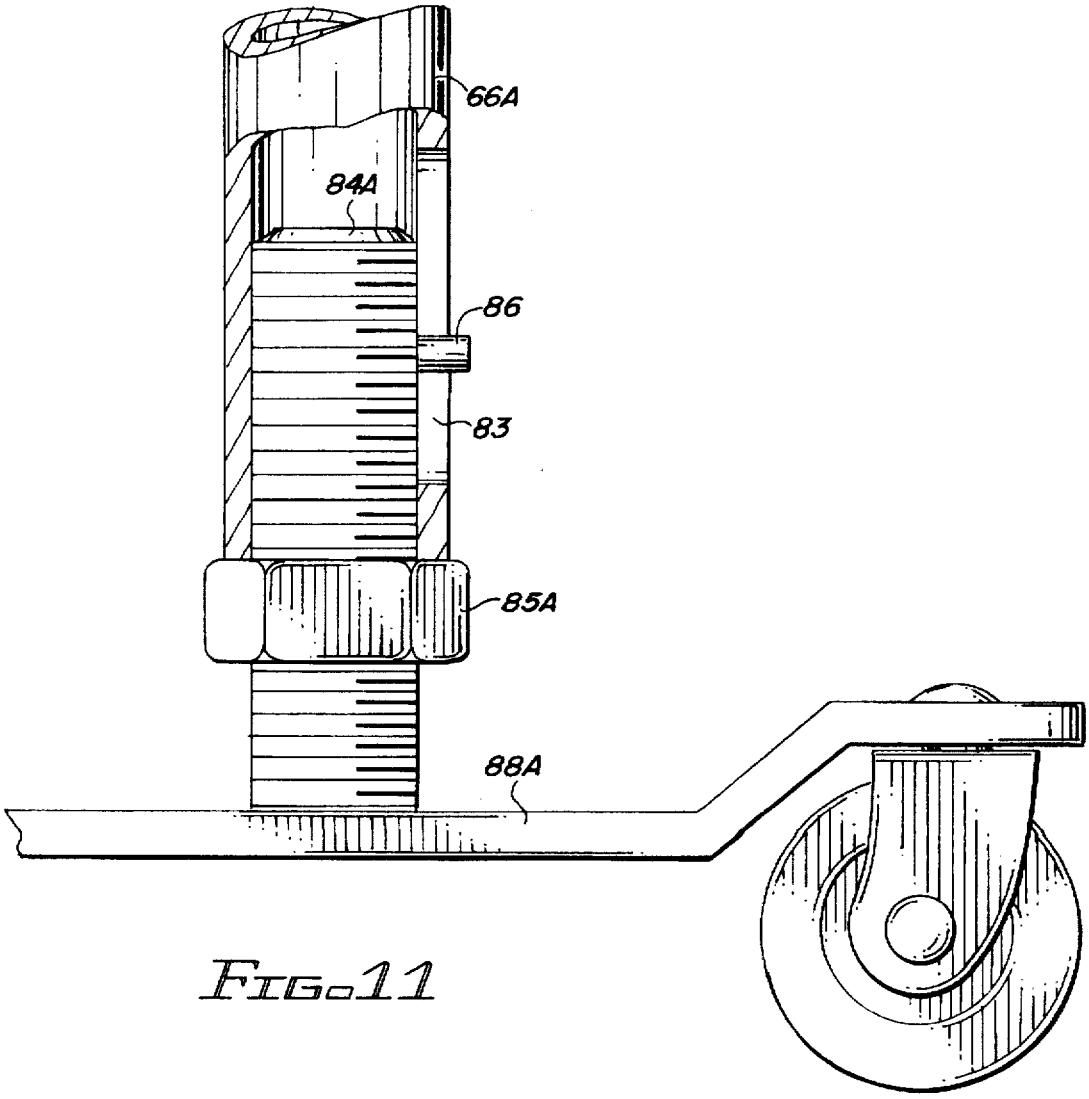
FIG. 11 shows an alternate adjusting mechanism for the tilt and roll assemblies.

FIG. 11 shows an alternate adjustment arranged on which lower leg 66A receives threaded shaft 84A which is secured to the pedestal base 88A. Leg 66A is longitudinally slotted at 83 and pin 86 which is secured to shaft 84A extending therein. Adjustment is accomplished by turning nut 85A.

Figure 9:
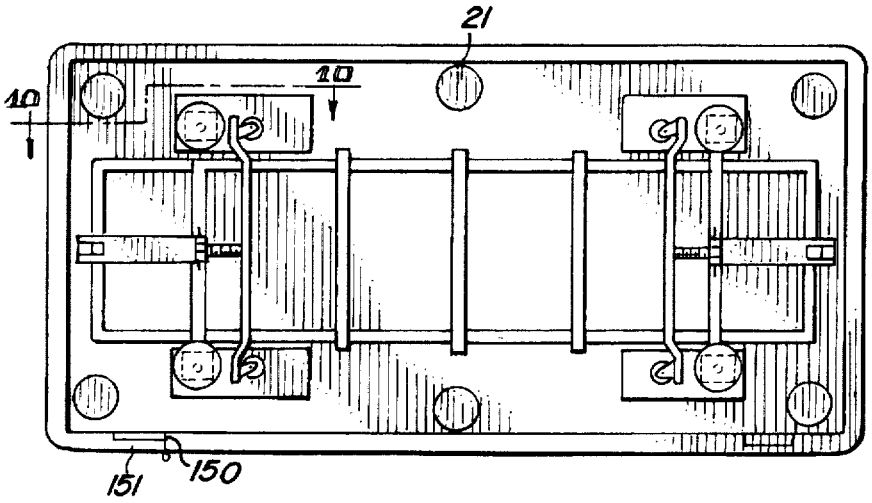
FIG. 9 is a plan view of the underside of a game table with the conventional legs extended and with the support legs in a folded condition.
Figure 10:
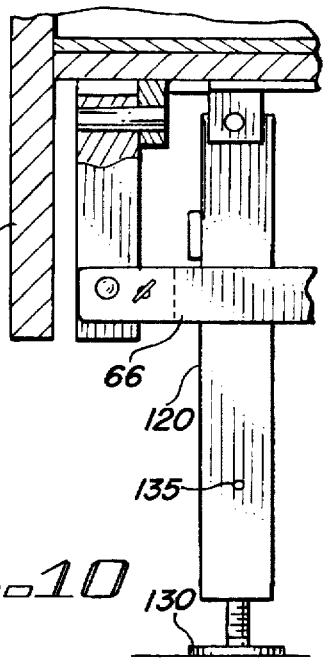
FIG. 10 is a sectional view taken along line 10—10 of FIG. 9.

The present invention will be better understood from the following description of use. Referring to FIGS. 7 through 10, a representative table, shown as a conventional pool table, is provided with legs 120 to 123 located on the underside of the table in the general area adjacent the corners of the table. Each of the legs 120 to 123 are pivotally secured to the underside of the table at a clevis 125. In the stored position as shown in FIG. 8, the legs assume a position adjacent the underside of the table and are secured in place by a pin 126 extending through an aperture in bracket 128 which is in registry with an aperture 135 in the leg, as for example leg 120 as shown in FIG. 10.

In addition, each of the legs 120 through 123 is provided with a leveling pad 130 which carries a threaded shaft 132 which engages a threaded recess 134 at the bottom of the legs. Rotation of the pad 130 will extend or retract the pad relative to the associated leg to level the table.

The table is shown in a stored position in FIG. 1. When it is desired to place the table in use, the user will manually transport the table to a use-position which is accommodated by the provision of casters 92. Once the table is properly located, the casters 92 are locked and the table may then be rotated to a horizontal position which is facilitated by the mounting of the support assemblies to the pivot shafts 50 and 54. The shafts 50 and 54 are located so the table is balanced with the legs 120 to 123 are retracted. Once the table is in the horizontal position, the legs 120 to 123 may be unlocked by disengaging pins 126 from the respective legs. This allows the legs to pivot downwardly to an extended, vertical position, preferably with a slight clearance between the supporting surface in the under side of the pads 130. At this point the table remains supported by the temporary support assemblies 60, 62. The user then levels the table by adjusting pads 130. When leveling is completed the user will then begin turning the adjustment nuts 85 associated with each of the assemblies in a direction to remove weight on the tilt and roll assemblies. Once this is done, the weight of the table has now been shifted to the conventional legs 120 to 123.

The tilt and roll assemblies 60, 62 may now each be pivoted to an out-of-the-way position. This is accomplished by removing the pins 70 and pivoting the lower leg members 66 upwardly and inwardly until they assume the position in dotted in FIG. 8. The pins 70 may then be replaced as shown in FIGS. 6 and 10 retaining the lower legs 66 in the upwardly, folded position. The pads 130 may then be further adjusted as is necessary to level the table and the table is ready for play. It is important to note that the table rails 16, 18, 20 and 22 serve to obscure the tilt and roll assemblies from view in the normal playing position.

When it is desired to store the table, the locking pins 70 are removed allowing the lower leg member 66 associated with the support assemblies 60, 62 to pivot downwardly to the position shown in full line in FIG. 8. The locking pins are then reinserted in aperture 72 which is now in registry with bore 74 locking the leg assemblies in the extended position. The adjustment nuts 85 are rotated in a direction to cause the pedestal member 88 to extend. As the pedestals extend, the weight will be removed from the normal support legs 120, 121, 122 and 123. The support legs can then be pivoted to the position shown in FIG. 8 along the under side of the table. When the weight from the table is fully supported on the temporary leg assemblies 60 and 62, the table may then be rotated to a vertical position.

Rotation to a vertical position is further facilitated by recesses 150 located in the side rail 18. It may be desirable to provide an access door or cover 151 which would be removable or would open outwardly at hinge 152 as seen in FIG. 9. This construction will accommodate and provide clearance for the opposite support assemblies 60 and 62. The stabilizing bars 100 may then be secured between the opposed leg assemblies and the table is now positioned where it may be conveniently rolled to an out-of-the-way position.

From the foregoing, it will be seen that the present invention provides a convenient game table support which permits the table to be easily tilted to a vertical position for transportation and storage. The table support is mobile and allows the table to be quickly moved and erected and adjusted to a level, horizontal position when placed in use. The present invention is sturdy and may be economically fabricated and is adaptable to a wide variety of table types. When not in use, the support assemblies remain attached to the table in an out-of-the-way position at the underside of the table.

It will be understood from the foregoing that various changes alterations and modifications can be made in the form, details and arrangements and proportions of the various parts without departing from the spirit and scope of the appended claims. For example various length adjusting mechanisms for the tilt and roll assemblies may be utilized including hydraulic, pneumatic or mechanical ratchet or jack arrangement.

I claim:

1. A table having a generally planar playing surface and a bottom surface and having a longitudinal and a transverse dimension, said table comprising:

(a) a plurality of main legs secured to the bottom of said table and moveable between an extended position supporting said table and a retracted position and which normally support the table in a use position in said extended position;

(b) adjustment means associated with said main legs for selectively increasing or decreasing the length thereof;

(c) a frame secured to said table bottom; and (d) a pair of tilt and roll support members disposed at opposite longitudinal locations, each of said tilt and roll members comprising:

(i) an upper leg member pivotally secured to said frame about a longitudinal axis;

(ii) a lower leg member pivotally secured to said upper leg member about a generally transverse axis, said lower leg member being pivotal between an extended and a stored position in which the lower leg is disposed below the table bottom; and (iii) base means having rollers associated therewith, said base means connected to said lower leg member by adjustment means to selectively adjust the position of said base means with respect to said lower leg member wherein said lower leg member and said base means may be pivoted from a stored position to a generally vertical position to transfer the weight of the table to said tilt and roll support members and whereby said tilt and roll support members may be moved to said stored position and said playing surface pivoted to a generally vertical position for mobility and storage.

2. The table of claim 1 wherein said tilt and roll support members each define engagement means and further including stabilizing rods selectively engageable in said engagement means to stabilize said tilt and roll members.

3. The table of claim 1 wherein said game table is a pool table.

4. The table of claim 3 wherein said pool table has a peripheral rail which has a vertical edge and wherein said edge defines recesses aligned with said support members and wherein said edge extends to an elevation below the playing surface to generally conceal said tilt and roll members when said tilt and roll members are in said stored position.

5. The table of claim 1 wherein said lower leg members each define a bore and wherein adjustment means comprises a piston slidable within said bore in each of said lower leg members, said piston having a threaded rod extending therefrom and nut means engaging said rod and abutting the associated said lower leg member.

6. The table of claim 1 wherein said lower leg members are each pivotally secured to said upper leg members at a pivot connection including apertures in said upper and lower leg members which are in registry in said extended position and further including a removable locking pin selectively insertable in said apertures.

7. The table of claim 6 wherein said locking pin is positionable in said apertures in said lower leg member when said lower leg members are folded to a stored position and in which position said locking pin engages the associated said upper leg member to retain said lower leg members in said stored position.

8. The table of claim 1 wherein said table is a game table having a slate base and wherein said longitudinal axis is substantially aligned with the center of gravity of the table.

* * * * *